US010661117B2

(12) United States Patent
Malone et al.

(10) Patent No.: US 10,661,117 B2
(45) Date of Patent: May 26, 2020

(54) METHOD AND APPARATUS FOR VARIABLE KNEE FLEXION SUPPORT

(71) Applicant: Xeras Medical Technologies, Inc., Boerne, TX (US)

(72) Inventors: Mark S. Malone, Boerne, TX (US); Cory R. A. Hallam, San Antonio, TX (US)

(73) Assignee: Xeras Medical Technologies, Inc., Boerne, TX (US)

( * ) Notice: Subject to any disclaimer, the term of this patent is extended or adjusted under 35 U.S.C. 154(b) by 35 days.

(21) Appl. No.: 15/579,154

(22) PCT Filed: Jun. 3, 2015

(86) PCT No.: PCT/US2015/034019

§ 371 (c)(1),
(2) Date: Dec. 1, 2017

(87) PCT Pub. No.: WO2016/195680

PCT Pub. Date: Dec. 8, 2016

(65) Prior Publication Data

US 2018/0169466 A1 Jun. 21, 2018

(51) Int. Cl.
*A63B 23/04* (2006.01)
*A61H 1/02* (2006.01)
(Continued)

(52) U.S. Cl.
CPC ..... *A63B 23/0494* (2013.01); *A61H 1/024* (2013.01); *A63B 21/002* (2013.01);
(Continued)

(58) Field of Classification Search
CPC ..... A61H 1/024; A61H 2201/0119; A61H 2201/0157; A61H 2201/0161; A61H 2201/0192; A61H 2201/0207; A61H 2201/0214; A61H 2201/105; A61H 2201/1253; A61H 2201/1261; A61H 2201/1284; A61H 2201/164; A61H 2201/168; A61H 2201/169;
(Continued)

(56) References Cited

U.S. PATENT DOCUMENTS 2,695,800 A 11/1954 Soucy
2,819,873 A 1/1958 Pearne
(Continued)

FOREIGN PATENT DOCUMENTS

CN 2885222 4/2007
WO WO2003068129 8/2003

OTHER PUBLICATIONS

International Search Report and Written Opinion issued in International Patent Application No. PCT/US2015/034019 dated Sep. 8, 2015 (16 pages).
(Continued)

*Primary Examiner* — Megan Anderson
(74) *Attorney, Agent, or Firm* — Pizarro Allen PC

(57) ABSTRACT

A system for promoting knee flexion may comprise a support bar and a plurality of pads removably mounted thereto, such that sequential use of the plurality of pads may progressively allow a knee joint to move through an increased range of motion.

20 Claims, 7 Drawing Sheets

(51) Int. Cl.
*A63B 21/00* (2006.01)
*A63B 21/002* (2006.01)

(52) U.S. Cl.
CPC ..... *A63B 21/40* (2015.10); *A61H 2201/0119* (2013.01); *A61H 2201/0157* (2013.01); *A61H 2201/0161* (2013.01); *A61H 2201/0192* (2013.01); *A61H 2201/0207* (2013.01); *A61H 2201/0214* (2013.01); *A61H 2201/105* (2013.01); *A61H 2201/1253* (2013.01); *A61H 2201/1261* (2013.01); *A61H 2201/1284* (2013.01); *A61H 2201/164* (2013.01); *A61H 2201/168* (2013.01); *A61H 2201/169* (2013.01); *A61H 2203/045* (2013.01); *A61H 2203/0443* (2013.01); *A61H 2203/0456* (2013.01); *A63B 2225/09* (2013.01)

(58) Field of Classification Search
CPC ..... A61H 2203/0443; A61H 2203/045; A61H 2203/0456; A63B 21/002; A63B 21/40; A63B 23/0494
See application file for complete search history.

(56) References Cited

U.S. PATENT DOCUMENTS 3,203,657 A 8/1965 Thompson
3,415,490 A 12/1968 Steele
3,602,492 A 8/1971 Petrie
3,672,361 A * 6/1972 Fourneron ..... A63B 21/0023 606/241
3,717,144 A 2/1973 Bimler
4,492,354 A 1/1985 Rice
4,700,373 A 10/1987 Miller
4,844,454 A 7/1989 Rogers
3,060,926 A 2/1991 May
5,025,802 A 6/1991 Laico et al.
5,074,549 A 12/1991 Harvey
5,190,513 A 3/1993 Habing et al.
5,333,604 A 8/1994 Green et al.
5,334,028 A 8/1994 Melligan
5,421,115 A 6/1995 McKay
5,435,411 A 7/1995 Borgatti
5,509,894 A 4/1996 Mason et al.
5,554,088 A 9/1996 Zlojutro
5,669,863 A * 9/1997 Ho ..... A63B 21/055 482/123
5,722,627 A 3/1998 Hoshino
5,746,688 A 5/1998 Prager
5,871,457 A 2/1999 Swedberg et al.
5,873,312 A 2/1999 Mauro-Vetter
5,878,453 A 3/1999 Stokes
5,935,050 A 8/1999 Shahan
5,971,902 A 10/1999 Robertson et al.
6,001,051 A 12/1999 Chuan-Pin
6,030,352 A 2/2000 Paik
6,048,293 A 4/2000 Lee
6,095,319 A 8/2000 Noniewicz et al.
D432,246 S 10/2000 Pestone
6,165,112 A 12/2000 Morris
6,238,320 B1 5/2001 Flanagan
6,254,517 B1 7/2001 Kennedy
6,287,244 B1 9/2001 Boos
6,309,330 B1 10/2001 Thornton
6,371,894 B1 4/2002 Hill
6,569,064 B1 5/2003 Loane
6,991,591 B1 1/2006 Tsatsouline
7,695,416 B2 4/2010 Weiner
7,784,749 B2 8/2010 Radermacher
8,012,047 B2 9/2011 Gamboa
D666,014 S 8/2012 Gruszynski
8,425,343 B1 4/2013 Olmos
8,646,731 B2 2/2014 Burles
9,498,399 B1 * 11/2016 Juntunen ..... A61H 1/024
9,962,311 B2 * 5/2018 Malone ..... A61H 1/024
10,123,736 B2 * 11/2018 Malone ..... A63B 21/4039
2003/0130097 A1 7/2003 Harrison
2003/0224880 A1 12/2003 Hansberry
2004/0049135 A1 3/2004 Callanan et al.
2005/0012000 A1 1/2005 Jones
2005/0159688 A1 7/2005 Sakamoto et al.
2006/0009336 A1 1/2006 Millet
2006/0014614 A1 * 1/2006 Szabo ..... A63B 21/00072 482/140
2006/0217249 A1 9/2006 Webber
2007/0298883 A1 12/2007 Feldman et al.
2008/0058173 A1 3/2008 Mattox
2008/0182730 A1 7/2008 Conley et al.
2009/0163837 A1 6/2009 Sanger et al.
2009/0275447 A1 11/2009 Fishman et al.
2010/0234192 A1 9/2010 Oller, Jr.
2011/0231995 A1 9/2011 Sedillo
2012/0115693 A1 5/2012 Franques Garcia
2013/0029814 A1 1/2013 D'Alessandro
2013/0110013 A1 5/2013 Carlson et al.
2013/0197403 A1 8/2013 Sevy et al.
2013/0211297 A1 8/2013 Method
2014/0038798 A1 2/2014 Littell
2014/0066271 A1 3/2014 Gray
2014/0073998 A1 3/2014 Keiser
2014/0087929 A1 3/2014 Sussman
2014/0094721 A1 4/2014 Diallo
2014/0228186 A1 8/2014 Montgomery
2016/0279011 A1 9/2016 Lutz
2016/0367427 A1 12/2016 Malone

OTHER PUBLICATIONS

Google Patents English translation of Foreign Patent Document 1, CN2885222, translated Jun. 26, 2017 (2 pages).
"Getting Back Out There," Trainer Rx, http://www.trainer-rx.com, Jun. 20, 2017 (7 pages).

* cited by examiner

METHOD AND APPARATUS FOR VARIABLE KNEE FLEXION SUPPORT

FIELD

The disclosed method and apparatus generally relate to physical therapy for knee joints.

BACKGROUND

The anatomy of a knee joint consists of three bones. These three specific bones are the femur (thighbone), the tibia (shinbone) and the patella (kneecap). The patella is located in front of the knee joint, and provides partial protection for the anterior portion of the knee. Typically, bones are connected to other bones through ligaments. Specifically, the knee joint has four ligaments functioning as resilient elastic cables linking the femur and tibia together for the purpose of maintaining knee joint stability.

Collateral ligaments are located vertically on opposed parallel sides of the knee joint. The medial collateral ligament is located on the outer inside of the knee joint, and links the femur and tibia. The lateral collateral ligament is located on the outer outside of the knee joint, and also links the femur and tibia. The purpose of the collateral ligaments is towards controlling knee joint sideways motion, thus fortifying the knee joint against unusual movement.

Cruciate ligaments are located inside of the knee joint, and cross each other in the general form of an "X". The anterior cruciate ligament is located in front, behind the patella, and the posterior cruciate ligament is located in the back, linking the femur and tibia and having a purpose towards controlling anterior and posterior movement of the knee joint.

Upon completion of knee joint surgery or other type of knee joint treatment, such as knee joint replacement or replacement or repair of any torn or damaged previously described ligaments, bone fracture and bone fracture surgery, or internal fixation surgery, or for treatment of arthritic conditions, or meniscus repair, or for knee injury recovery, regaining normal knee joint flexibility, range of motion and strength typically requires a physical therapy rehabilitation program.

Following knee surgery, or arthritic treatment, or injury treatment, or other procedure or course of treatment for the knee joint, physical therapy may be beneficially applied to restoring full and painless motion of the knee joint, along with re-establishing associated ligament and muscle suppleness. Restoration may be followed by a knee joint strengthening program focused on regaining normal function of the knee joint. A physical therapy program progressively stretches muscle(s) and tendon(s) to their former flexibility. A final rehabilitation phase encourages complete return of normal knee joint functionality.

There remains a need for an apparatus and method for a knee joint flexion support allowing for incrementally-applied physical therapy.

SUMMARY

A system for knee flexion support may comprise a knee support bar; and a plurality of pads configured to removably mount to the knee support bar, each pad having an outer diameter different from that of another of said plurality of pads.

A method of promoting knee joint flexion may comprise nestably and removably mounting a plurality of pads to a support bar; positioning the support bar, having mounted the plurality of pads, at the posterior of a knee joint; moving the knee joint through a first range of motion; removing the support bar from the posterior of the knee joint; removing the outermost pad of the plurality of pads from the support bar; positioning the support bar, having the outermost pad removed, at the posterior of the knee joint; and moving the knee joint through a second range of motion.

A method of promoting knee joint flexion may comprise removably mounting a first pad to a support bar, the first pad comprising a first outer diameter; positioning the support bar, having mounted the first pad, at the posterior of a knee joint; moving the knee joint through a first range of motion; removing the support bar from the posterior of the knee joint; removing the first pad from the support bar; removably mounting a second pad to a support bar, the second pad comprising a second outer diameter less than the first outer diameter; positioning the support bar, having mounted the second pad, at the posterior of the knee joint; and moving the knee joint through a second range of motion.

A knee joint flexibility rehabilitation apparatus may comprise a tubular strut having a first support foot and a bracket attached thereto, the tubular strut forming a first aperture; a height-adjustment bar translatably and rotatably disposed in the tubular strut, the height-adjustment bar forming a plurality of second apertures extending through the diameter of the height-adjustment bar; a support bar fixed substantially perpendicularly to the height-adjustment bar, the padded support bar being configured to receive a knee joint posterior; a plurality of pads configured to removably mount to the support bar, each pad having an outer diameter different from that of another of said plurality of pads; a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction.

A method of using the foregoing knee joint flexibility rehabilitation apparatus may comprise nestably and removably mounting the plurality of pads to the support bar; orienting a patient to a supine position upon a substantially level surface; raising the patient's leg; disposing the apparatus under the patient's leg so that the first support foot is adjacent the patient's buttocks, and the tubular member is substantially parallel the thigh of the patient's leg; translating the height-adjustment bar so that the support bar, having mounted the plurality of pads, contacts the posterior knee joint of the patient's leg or approximately thereto; allowing the lower portion of the patient's leg to extend past the support bar in cantilever fashion so as to permit a gravitational force on the lower portion to promote rehabilitation of the knee joint; moving the knee joint through a first range of motion; removing the knee from the support bar; removing the outermost pad of the plurality of pads from the support bar; replacing the knee on the support bar, having the outermost pad removed; and moving the knee joint through a second range of motion.

A system for knee flexion support may comprise a plurality of knee support bars, each knee support bar having an outer diameter different from that of another of said plurality of knee support bars; and a plurality of pads, each pad being configured to mount to at least one of said plurality of knee support bars.

A knee joint flexibility rehabilitation apparatus may comprise a tubular strut having a first support foot and a bracket attached thereto, the tubular strut forming a first aperture; a height-adjustment bar translatably and rotatably disposed in the tubular strut, the height-adjustment bar forming a plurality of second apertures extending through the diameter of the height-adjustment bar; a plurality of knee support bars, each knee support bar having an outer diameter different from that of another of said plurality of knee support bars, each knee support bar being configured for removable mounting to the height-adjustment bar, each knee support bar being configured to receive a knee joint posterior; a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction.

DETAILED DESCRIPTION

Disclosed is a knee flexion support apparatus and method, specifically adapted for knee joint flexibility rehabilitation following knee joint surgery or other type of knee joint treatment, such as knee joint replacement or replacement or repair of any torn or damaged previously described ligaments, bone fracture and bone fracture surgery, or internal fixation surgery, or for treatment of arthritic conditions, or meniscus repair, or for knee injury recovery, regaining normal knee joint flexibility, range of motion and strength. The apparatus is capable of use for reducing muscle spasm, pain and swelling; having such arrangement to provide appropriate flexion support of the posterior intersection concerning the femur and tibia of a non-operative, arthritic, injured, fractured, or post-operative recovering knee joint; promoting deliberate gravity assisted passive flexion towards gradual knee joint muscle and tendon stretching, and mechanical decompression of the knee joint to alleviate pain, pressure, swelling, and general discomfort.

The disclosed apparatus arrangement may comprise a plurality of pads for a knee flexion support bar. The support bar may be substantially straight, or may comprise one or more curves. The support bar may be provided as part of a knee flexion rehabilitation device, such as that disclosed in PCT/US15/19336, filed Mar. 7, 2015, and entitled Method and Apparatus for Knee Joint Flexibility Rehabilitation, the entire disclosure of which is incorporated herein by reference. Those having skill in the art will appreciate that the pads may be used with any other suitable support bar.

Figure 1:
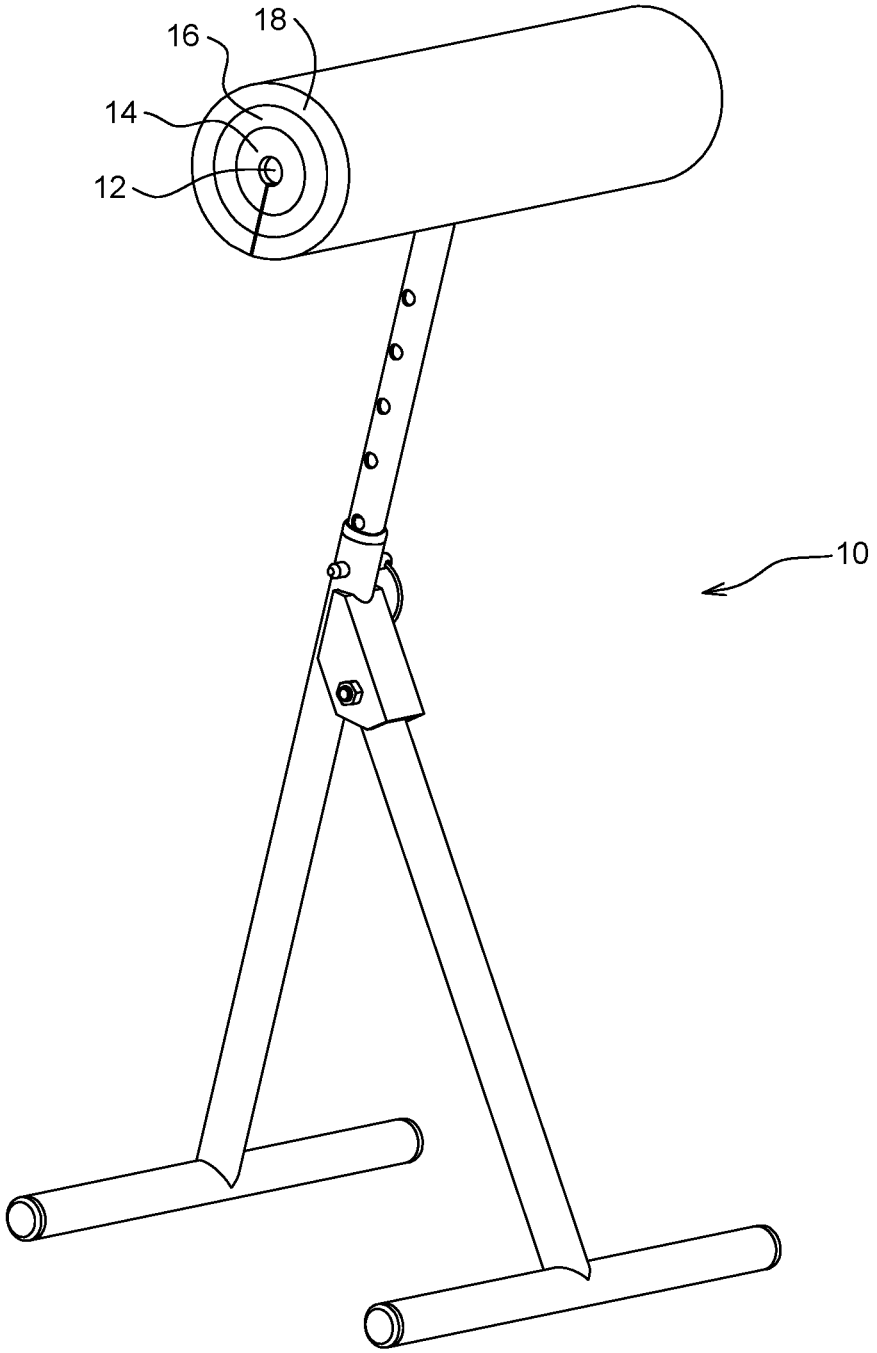
FIG. 1 illustrates one embodiment of a system for knee flexion support mounted to a knee joint flexibility rehabilitation device.
Figure 2:
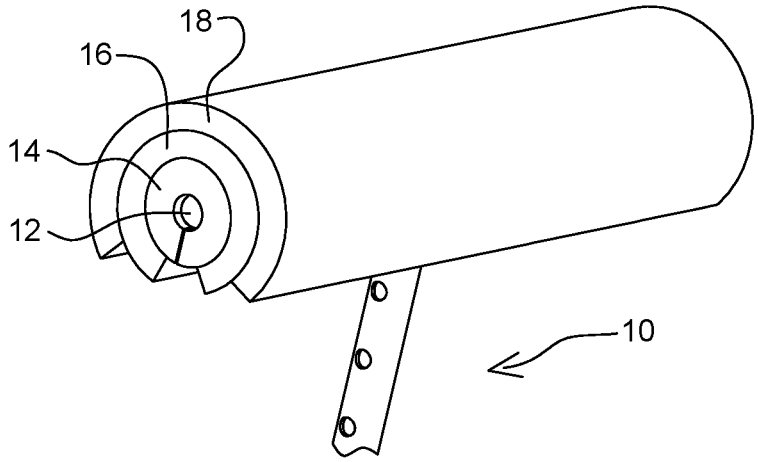
FIG. 2 illustrates another embodiment of a system for knee flexion support.

As may be seen in the embodiment of FIG. 1, a knee flexion rehabilitation device 10 may comprise a support bar 12 upon which a knee may rest. A system of two or more pads may be deployed as described herein to permit incremental knee flexion. In one embodiment, the system may comprise a nested arrangement of pad layers, as shown in FIG. 1. In such an embodiment, a base pad 14 may cover the support bar as a first pad layer. A second pad layer 16 may cover the base pad, and a third pad layer 18 may cover the second pad. In FIG. 1, the layers are illustrated as wrapping around substantially the entire support bar circumference. In other embodiments, one or more layers may partially wrap around the support bar circumference, as shown in the embodiment of FIG. 2.

Figure 3A:
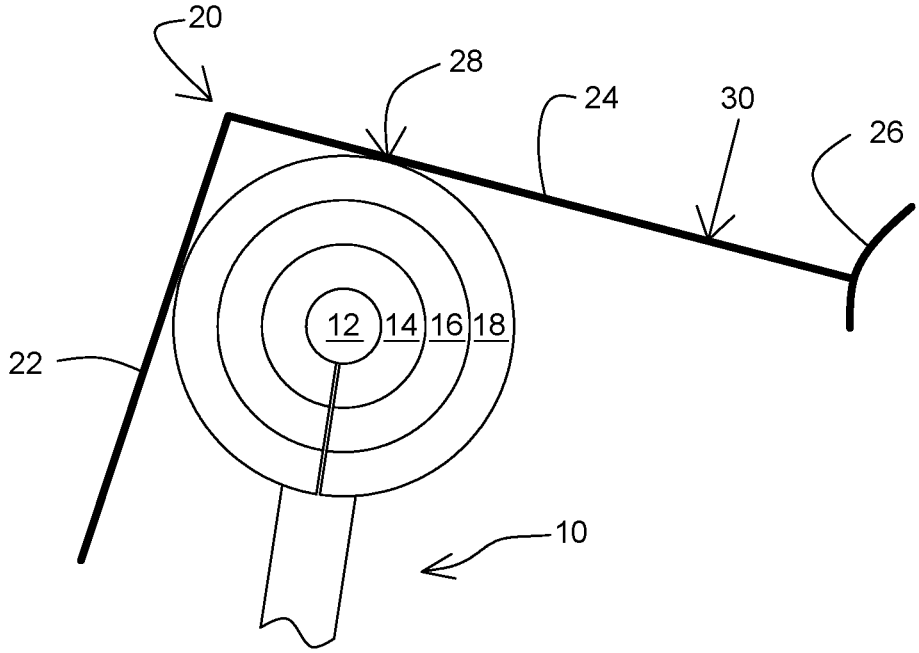
FIG. 3A-C illustrates a method of using the embodiment of FIG. 1 to promote knee flexion.

As may be seen in those embodiments, the layers may incrementally increase the diameter of the support bar to allow a physical therapist a method of incrementally increasing a patient's knee flexion. With reference to the embodiment of FIG. 3A-C, a patient may have limited range of motion in a knee 20, which may allow only a relatively large angle between the femur 22 and tibia 24. For such a patient, a plurality of layers may be used to increase the effective diameter of the support bar 12. In the embodiment of FIG. 3A, a first layer 14, a second layer 16 and a third layer 18 may be disposed around the support bar 12, thus providing a larger diameter support. While a patient is supine, for example, the patient's leg may rest over the support 10 such that the support bar 12 is disposed substantially under the patient's knee 20. The patient's lower leg, which may include the tibia 24 and foot 26, may extend out past the support bar 12. The support bar 12 may thus serve as a fulcrum point or area 28 upon which the upper portion of the lower leg may rest and pivot. The larger diameter support bar ensures that the support bar is disposed away from the femur a distance approximating the radius of the support bar, thus establishing the fulcrum point farther away from the knee. So disposed, the physical therapist may move the lower leg through a range of motion to help stretch the knee joint tissues. The lower leg may effectively serve as a lever, with the femur and patient's body weight at the knee side of the fulcrum point serving as an anchor weight, and gravity force and/or the physical therapist's pressure 30 at the foot end of the lower leg serving to distract the knee joint. The fulcrum placement may alter the mechanical advantage of the lever so as to selectively multiply the physical therapist's force or effect of gravity. A larger diameter may allow a physical therapist to treat a knee joint shortly after surgery, for example, and may allow for increased patient comfort even with substantial post-operative swelling. A larger diameter may effectively provide a larger surface area on which the patient's leg may rest, thus reducing fulcrum effect and correspondingly reducing patient discomfort.

Figure 3B:
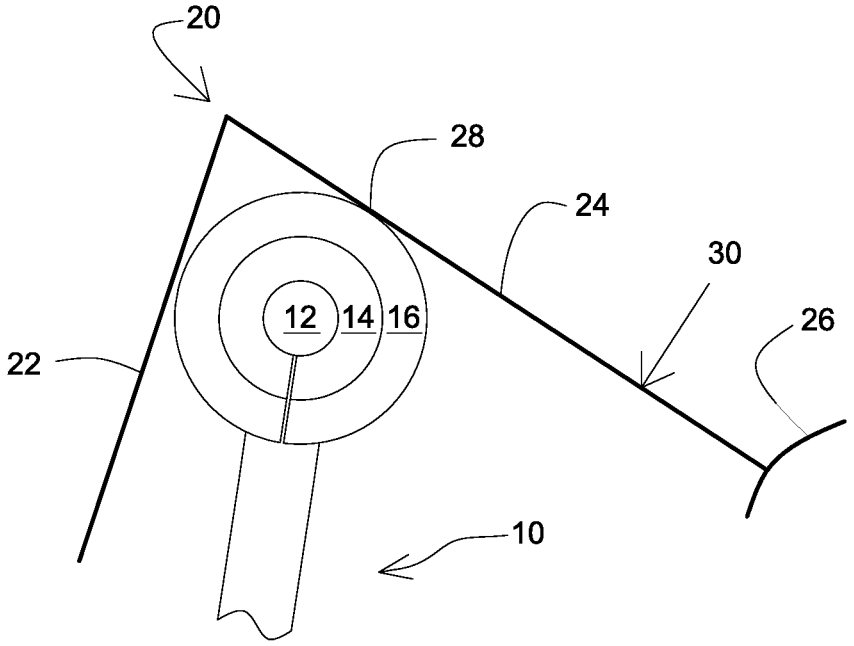

As the range of motion of the knee 20 increases, the third layer 18 may be removed from the support bar, thus reducing the effective diameter of the support bar, as may be seen in the embodiment of FIG. 3B. The second layer 16 may thus support the lower leg directly. The smaller effective diameter of the support bar may allow for a more acute angle between the femur 22 and tibia 28 than the angle allowed by the third layer 18. The second layer 16 may allow the fulcrum point 28 to be closer to the knee joint, thus changing the mechanical advantage provided by the support bar and further multiplying the force 30.

Figure 3C:
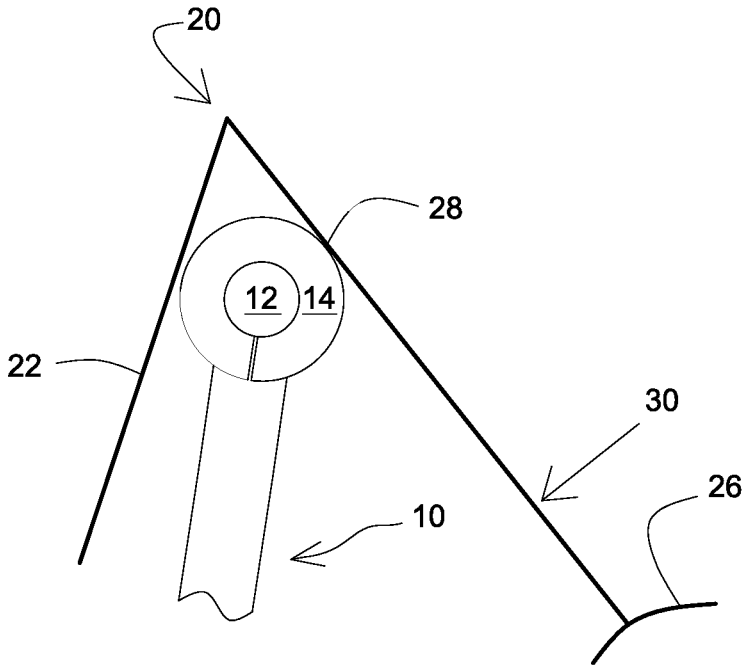

As the range of motion of the knee 20 still further increases, the second layer 16 may be removed from the support bar, thus reducing the effective diameter of the support bar, as may be seen in the embodiment of FIG. 3C. The first layer 14 may thus support the lower leg directly. The smaller effective diameter of the support bar may allow for an even more acute angle between the femur 22 and tibia 28 than the angle allowed by the second layer 16. The first layer 14 may allow the fulcrum point 28 to be closer to the knee joint, thus changing the mechanical advantage provided by the support bar and yet further multiplying the force 30. Thus, by changing the effective diameter of the support bar, the physical therapist may effectively control the maximum flexion angle.

Figure 4C:
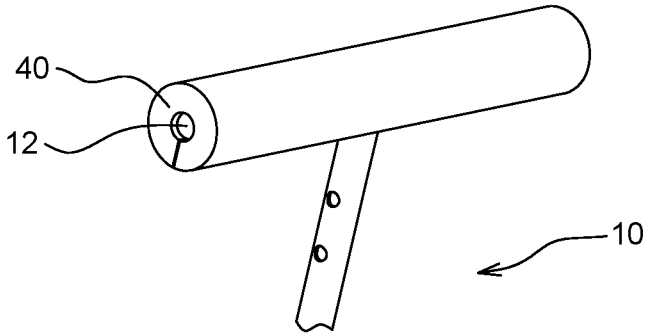
FIG. 4A-C illustrates a system and method of pads having different thicknesses for knee flexion support.
Figure 4B:
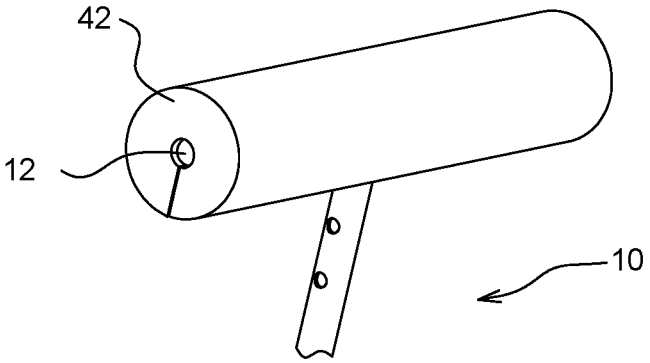
Figure 4A:
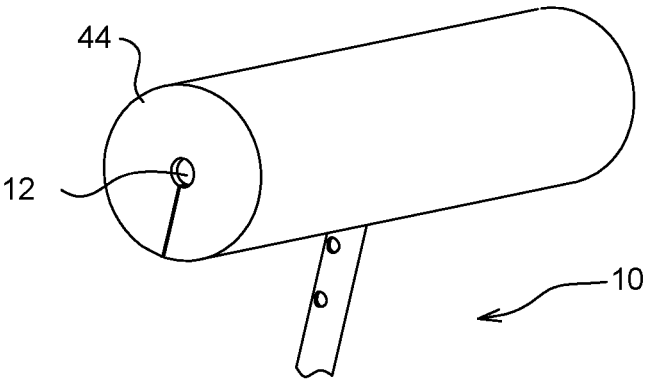

In the embodiment of FIG. 1, the layers may have equal or different thicknesses. In other embodiments, a system of layers may be provided, with each layer having a different thickness, as in the embodiment of FIGS. 4A-C. In the embodiment of FIG. 4A-C, three pads 40, 42 and 44 may be used to provided for separate use on a support bar 12. Each of the three pads 40, 42 and 44 may have a different thickness, and each may thus provide a different effective diameter for the support bar. For example, instead of using pads 14, 16 and 18 (FIGS. 3A-C) to effectively increase the diameter of the support bar, a single pad 44 (FIG. 4A) may be independently used to effectively achieve that effective diameter of the support bar. Similarly, a single pad 42 (FIG. 4B) may be used to achieve the effective diameter provided by pads 14 and 16 of FIGS. 3A-C, and a single pad 40 (FIG. 4B) may be used to achieve the effective diameter provided by pad 14 of FIGS. 3A-C.

Accordingly, a method for using a knee flexion support system may comprise establishing a support bar, effectively increasing the diameter or a cross-section dimension of the support bar by attaching one or more pads thereto, supporting a knee joint on the dimensionally-enlarged support bar for initial flexibility treatment, reducing the diameter or a cross-section dimension of the support bar by removing or changing one or more pads, and supporting a knee joint on the dimensionally-enlarged support bar for subsequent flexibility treatment.

Figures 5, 5A:
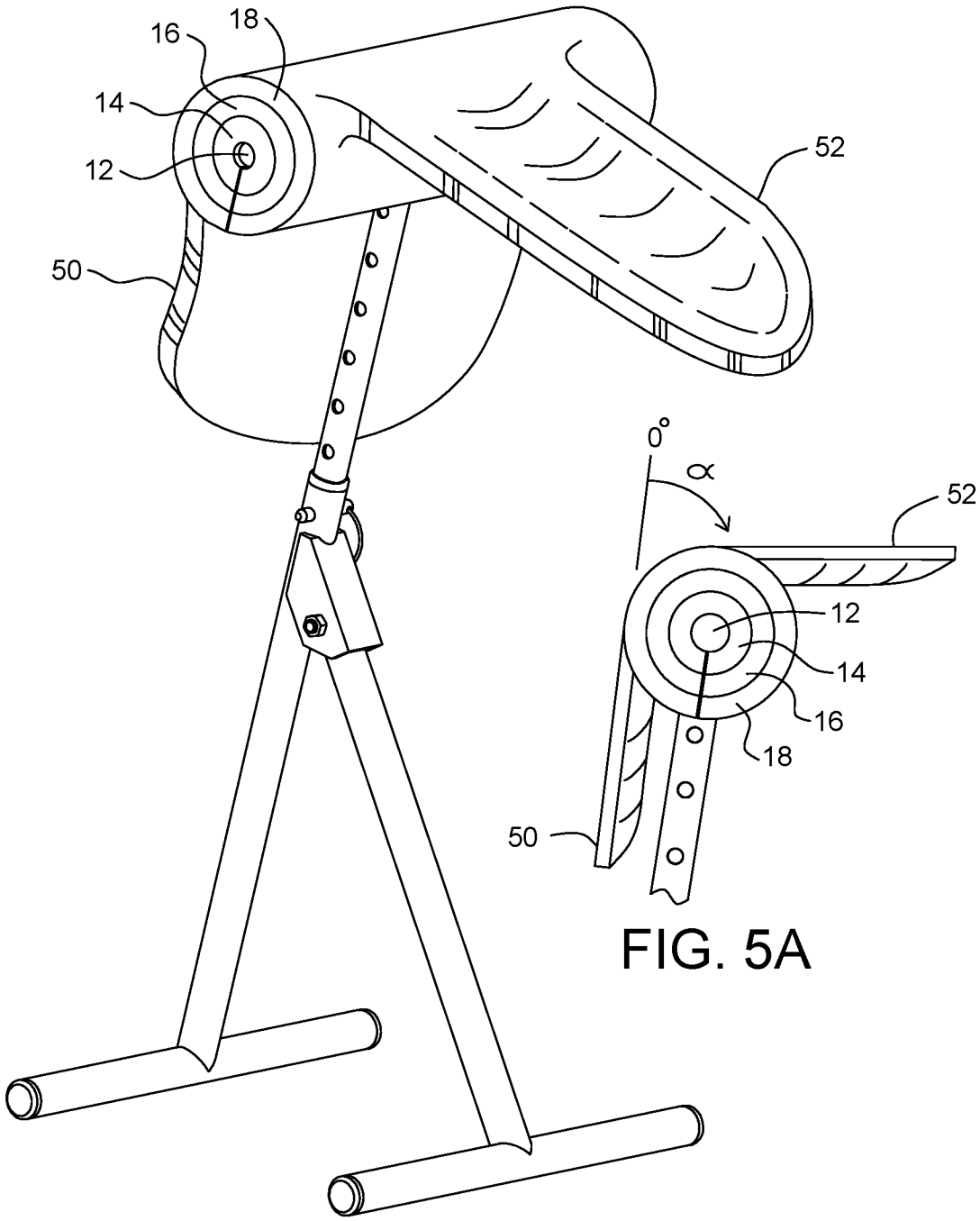
FIG. 5 illustrates an embodiment of a pad having resilient support members.

In other embodiments, one or more of the pads may be provided with one or more wings against which the femur and/or tibia may rest to further control range of motion. Each wing may extend from a pad at a tangent thereto. A single-wing embodiment may be keyed to the support bar so as to substantially restrict rotation of the wing about the support bar. In the embodiment of FIG. 5, the outer layer may comprise a femur support wing 50 and a tibia support wing 52 that may further support a patient's leg. If two wings are used, then second wing 52 may be positioned in a suitable angular range a from the first wing 50, as illustrated in FIG. 5A. Angular range a may be from about 0 degrees to about 120 degrees, or more particularly from about 20 degrees to about 100 degrees. The wings may comprise any suitably rigid material or resilient material, such as foam, plastic, rubber, metal or fiberglass.

Figure 6:
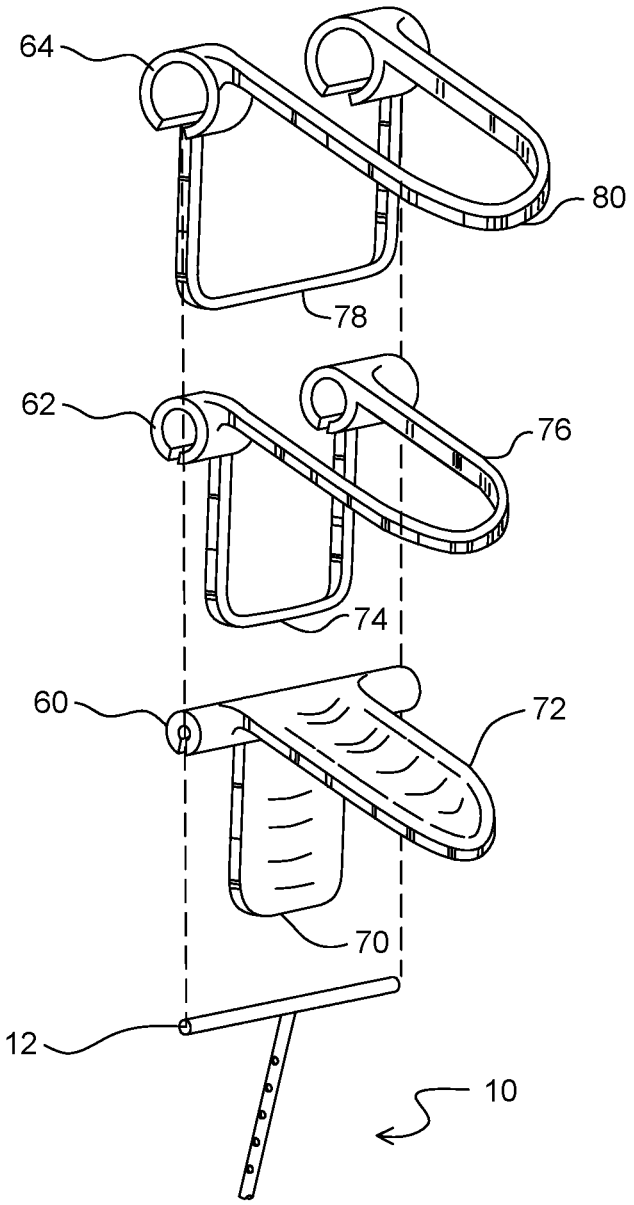
FIG. 6 illustrates an embodiment of a plurality of pads, each having nested wings.

In some embodiments, such as those of FIG. 6, a system of layered pads 60, 62, 64 may provide nestable support wings 70, 72, 74, 76, 78, 80. Of course, one or more wings may also be provided on pads configured for sequential mounting to a support bar, such as those pads depicted in FIGS. 4A, 4B and 4C.

Figure 7A:
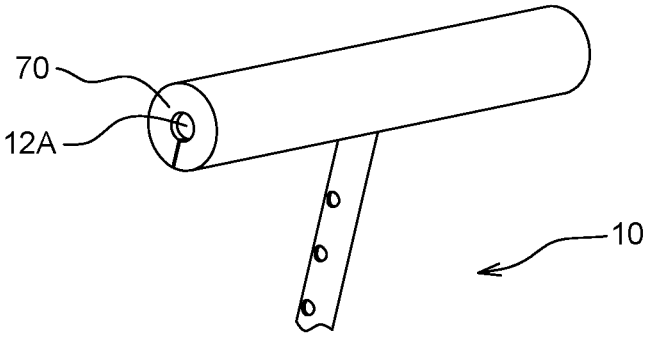
FIG. 7A-C illustrates a system and method of support bars having different diameters for knee flexion support.
Figure 7B:
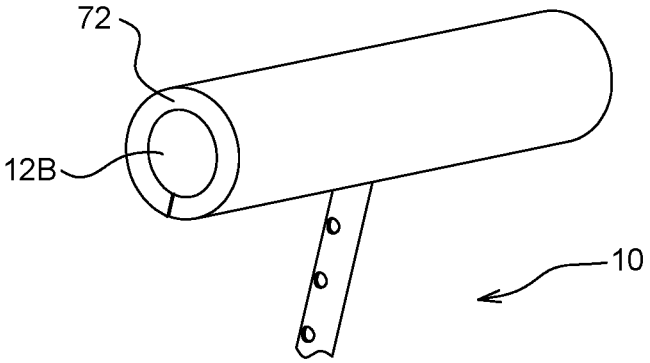
Figure 7C:
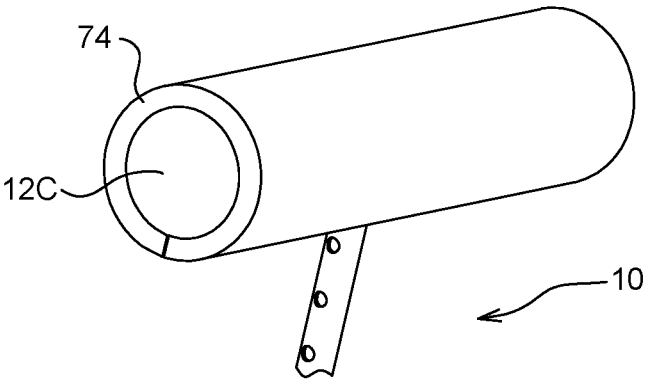

In yet further embodiments, a system of support bars may be provided, wherein each support bar may comprise a different diameter. As may be seen in the embodiment of FIGS. 7A, 7B and 7C, a plurality of support bars 12A, 12B and 12C may be provided, with each support bar comprising a different diameter. Support bar 12A may be, for example, 0.5 inches in diameter. Support bar 12B may be, for example, 1.5 inches in diameter. Support bar 12C may be, for example, 2.5 inches in diameter. In some embodiments, each support bar 12A, 12B and 12C may be covered by a pad 70, 72 and 74, respectively. In other embodiments, a support bar may not be covered by a pad. The pads 70, 72 and 74 may be of the same or different thickness, material, color, texture or marking as suitable to provide a desired overall diameter of support bar and pad. For example, each pad 70, 72 and 74 may be 0.5 inches thick, thus rendering the overall diameter for support bars 12A, 12B and 12C with pads 70, 72 and 74 as 1.5 inches, 2.5 inches and 3.5 inches, respectively. Of course, the number of such support bars is not limited to three, and any number of such support bars may be provided as desired to provide a supported range of knee joint motion. The plurality of support bars may be configured for removable or interchangeable mounting to a support 10. In other embodiments, a plurality of supports 10 or components thereof may be provided, each having a different diameter support bar. In yet further embodiments, each of the plurality of support bars may be configured to receive one or more nested pads, such as the nested pads as described above. Thus, varying support bar diameters and pad arrangements may be used to provide a plurality of overall support diameters suitable for treating a patient's condition.

A system of such support bars may be used progressively as described above to provide various overall support diameters. For example, a support bar 12C with pad 74 may be used initially to support a patient's knee through a first range of motion, then a support bar 12B with pad 72 may be used to support a patient's knee through a second range of motion greater than the first range of motion, and then a support bar 12A with pad 70 may be used to support a patient's knee through a third range of motion greater than the second range of motion.

Thus, a system of pads may provide for separate pad use, or may provide for pad layers. The pads may be color-coded, textured, labeled, or otherwise suitably marked to indicate the approximate range of angles provided by the pad, and/or to indicate the order of use. By varying the effective diameter of the support bar, the physical therapist (or patient, or doctor or other caregiver, as the case may be) may allow therapy to progress through each layer or pad size based on the patient's level of comfort, thus better allowing for a patient-specific recovery regimen. A system may provide a plurality of pads having dimensions suitable for allowing finer or coarser increments between ranges of motion. For example, a system of five layered pads may provide the same effective diameter as a system of three layered pads, but may provide smaller range-of-motion increments than the three-layer system. Similarly, a system of five pads for sequential placement on the support bar may provide the same maximum effective diameter as a system of three pads, but may provide smaller range-of-motion increments than the three-pad system.

For example, a system of four layered pads may comprise a first pad having an outer diameter of about 1.5 inches and configured to mount to a support bar, a second pad having an outer diameter of about 2.5 inches and configured to nest over the first pad, a third pad having an outer diameter of about 3.5 inches and configured to nest over the second pad, and a fourth pad having an outer diameter of about 4.5 inches and configured to nest over the third pad. The first pad may be color-coded red and labeled with a range-of-motion (ROM) marking indicating a range of motion up to about 90 degrees (as measured by a goniometer). The second pad may be color-coded blue and labeled to indicate a ROM of up to about 105 degrees. The third pad may be color-coded green and labeled to indicate a ROM of up to about 120 degrees. The fourth pad may be color-coded purple and labeled to indicate a ROM of up to about 135 degrees. Of course, any number of such pads may be used in a variety of thicknesses to provide desired ranges of motion.

In another example, a system of three pads may comprise a first pad having an outer diameter of about 4.5 inches and configured to mount to a support bar, a second pad having an outer diameter of about 3.5 inches and configured to mount to a support bar, a third pad having an outer diameter of about 2.5 inches and configured to mount to a support bar, and a fourth pad having an outer diameter of about 1.5 inches and configured to mount to a support bar. The first pad may be color-coded red and labeled with a range-of-motion (ROM) marking indicating a range of motion up to about 90 degrees (as measured by a goniometer). The second pad may be color-coded blue and labeled to indicate a ROM of up to about 105 degrees. The third pad may be color-coded green and labeled to indicate a ROM of up to about 120 degrees. The fourth pad may be color-coded purple and labeled to indicate a ROM of up to about 135 degrees. Of course, any number of such pads may be used in a variety of thicknesses to provide desired ranges of motion.

A system of pads may thus comprise a kit having a plurality of pads, and instructions for use. A pad carrier may be provided to allow for ready arrangement, transportation, storage and deployment of the system. The pad carrier may allow for ready visual identification of each pad. Instructions may be printed on the pads, and/or separately provided in a manual. The pads may be provided as part of a knee flexion rehabilitation device, or as a separate system. The system may be configured for use with any other suitable support bar, such as the back of a chair or the edge of a table or chair or bed.

Similarly, a system of support bars may comprise a kit having a plurality of support bars, and instructions for use. A support bar carrier may be provided to allow for ready arrangement, transportation, storage and deployment of the system. The support bar carrier may allow for ready visual identification of each support bar. Instructions may be printed on the support bars, and/or separately provided in a manual. The support bars may be provided as part of a knee flexion rehabilitation device, or as a separate system. The system may be configured for use with any other suitable support system.

In yet further embodiments, a system of pads and support bars may comprise a kit having a plurality of pads and support bars, and instructions for use. A pad and support bar carrier may be provided to allow for ready arrangement, transportation, storage and deployment of the system. The pad and support bar carrier may allow for ready visual identification of each pad and support bar. Instructions may be printed on the pads and support bars, and/or separately provided in a manual. The pads and support bars may be provided as part of a knee flexion rehabilitation device, or as a separate system.

The pads may comprise any suitable material, such as foam, plastic, fabric, gel, and the like. Similarly, the pads may be solid, inflatable, hollow, or contain internal structural components for rigidity and shape. The pads may comprise any suitable density, stiffness and elasticity desired for patient comfort and condition. For example, a system of pads may comprise pads having a density and compliance configured meet needs of specific patient conditions (such as arthritis, TKA, meniscus repair, ligament repair, broken bone recovery, for example). Those having skill in the art will appreciate that some surgeries and uses may require softer layers depending on the sensitivity and severity of the condition of the knee joint, the presence and location of sutures and bandages, and degree of swelling.

The pads may further comprise any suitable coating and outer surface texture. In some embodiments, the pads may be sterilizable for re-use, or may be disposable. In yet other embodiments, the pads may comprise a substantially breathable surface to allow moisture and patient fluids to wick away from the leg. In yet further embodiments, the pads may comprise impermeable surfaces that may be cleaned. In other embodiments, a disposable cover may be placed over one or more of the pads. In further embodiments, a pad or outer layer may be coated with balm or medicated salve to promote patient comfort or healing (such as for heating or cooling, or a such as a lotion, lubrication, or pain relief medication).

Furthermore, the pads may be suitably shaped to cradle the knee joint, or to provide a smaller fulcrum point. The effective diameter of the support bar may be changed by pads having substantially uniform thickness, or may be changed by pads having varying thickness. The cross-sectional shape of the pads may be round, square, rectangular, triangular or have a different polygonal shape, or may be irregularly shaped. The support bar may be tubular, or round. If the pads are irregularly shaped, or have a varying thickness, the support bar may be square or keyed to substantially prevent the pad from slipping about the support bar. Thus, the pads may effectively increase a radius or cross-sectional dimension of the support bar. The pads may be removably affixed to the support by any suitable device, such as hook-and-loop fastener, interlocking surface texture, interlocking configuration, adhesive, friction fit, the weight of the patient's leg, pins, screws, clamps, or straps.

Although the disclosed subject matter and its advantages have been described in detail, it should be understood that various changes, substitutions and alterations can be made herein without departing from the invention as defined by the appended claims. Moreover, the scope of the claimed subject matter is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods or steps.

What is claimed is:

1. A system for knee flexion support, the system comprising:

a knee support bar; and a plurality of pads configured to removably mount to the knee support bar, each of the plurality of pads is having an outer diameter different from that of another of said plurality of pads;

the plurality of pads comprising a first pad configured to mount to the knee support bar and a second pad configured to nestably mount to the first pad;

said plurality of pads being sized in increments to support different ranges of motion for a patient's knee, the plurality of pad being marked to identify an order of use to incrementally increase a supported range of motion for the patient's knee during rehabilitation of the patient's knee.

2. The system of claim 1, wherein each of the plurality of pads comprises a color perceptibly different from that of another of said plurality of pads.

3. The system of claim 1, wherein each of the plurality of pads comprises a range-of-motion marking indicating the range of knee joint motion allowed by said pad.

4. The system of claim 1, wherein the knee support bar is rigid and straight.

5. The system of claim 1, wherein the plurality of pads further comprise up to eighteen additional pads.

6. The system of claim 1, wherein the plurality of pads further comprise up to ten additional pads.

7. The system of claim 1, wherein the the plurality of pads further comprises an additional pad.

8. A knee joint flexibility rehabilitation apparatus comprising:

a tubular strut having a first support foot and a bracket attached thereto, the tubular strut forming a first aperture;

a height-adjustment bar translatably and rotatably disposed in the tubular strut, the height-adjustment bar forming a plurality of second apertures extending through the diameter of the height-adjustment bar;

a support bar fixed perpendicularly to the height-adjustment bar, the padded support bar being configured to receive a knee joint posterior;

a plurality of pads configured to removably mount to the support bar, each of the plurality of pads having an outer diameter different from that of another of said plurality of pads;

said plurality of pads being sized in increments to support different ranges of motion for a patient's knee, the plurality of pad being marked to identify an order of use to incrementally increase a supported range of motion for the patient's knee during rehabilitation of the patient's knee;

a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction.

9. The system of claim 8, wherein plurality of pads comprise a first pad configured to mount to the support bar and a second pad configured to nestably mount to the first pad.

10. The system of claim 8, wherein each of the plurality of pads is configured to allow a different range of motion for a knee joint.

11. The system of claim 8, wherein the support bar is rigid and straight.

12. The system of claim 8, wherein the plurality of pads comprises a number of pads in a range of two to twenty pads.

13. The system of claim 8, wherein the plurality of pads comprises a number of pads in a range of two to twelve pads.

14. The system of claim 8, wherein the plurality of pads comprises three pads.

15. The apparatus of claim 8, the pin being further removably disposed in the first aperture to fix the height-adjustment bar against rotation and translation.

16. The apparatus of claim 8, wherein the first foot is perpendicular to the tubular strut, and the second foot is perpendicular to the support strut.

17. The apparatus of claim 8, wherein the support bar is padded.

18. The apparatus of claim 8, wherein the bracket is configured to prevent travel of the support strut away from the tubular strut beyond a predetermined angle.

19. A knee joint flexibility rehabilitation apparatus comprising:

a tubular strut having a first support foot and a bracket attached thereto, the tubular strut forming a first aperture;

a height-adjustment bar translatably and rotatably disposed in the tubular strut, the height-adjustment bar forming a plurality of second apertures extending through the diameter of the height-adjustment bar;

a support bar fixed perpendicularly to the height-adjustment bar, the padded support bar being configured to receive a knee joint posterior;

a plurality of pads configured to removably mount to the support bar, each of the plurality of pads having an outer diameter different from that of another of said plurality of pads;

a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction;

wherein the pad of the plurality of pads having the greatest outer diameter comprises a first wing extending at a first tangent therefrom.

20. A knee joint flexibility rehabilitation apparatus comprising:

a tubular strut having a first support foot and a bracket attached thereto, the tubular strut forming a first aperture;

a height-adjustment bar translatably and rotatably disposed in the tubular strut, the height-adjustment bar forming a plurality of second apertures extending through the diameter of the height-adjustment bar;

a plurality of knee support bars, each of the plurality of knee support bars having an outer diameter different from that of another of said plurality of knee support bars, each of the plurality of knee support bars being configured for removable mounting to the height-adjustment bar, each of the knee support bars being configured to receive a knee joint posterior;

a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction.

* * * * *